US005992408A

United States Patent [19]

Chen

[11] Patent Number: 5,992,408

[45] Date of Patent: Nov. 30, 1999

[54] PORTABLE GAS-STOVE

[76] Inventor: Jan-Mao Chen, Rm 5C01, No. 5, Hsin Rd. Sec. 5, Taipei, Taiwan

[21] Appl. No.: 09/052,423

[22] Filed: Mar. 31, 1998

[51] Int. Cl.[6] ..... F24C 5/00; F24C 5/04; A21B 1/52

[52] U.S. Cl. ..... 126/43; 126/38; 126/275 R; 126/45

[58] Field of Search ..... 126/38, 275 R, 126/43, 45, 44

[56] References Cited

U.S. PATENT DOCUMENTS

| | | | |
|---|---|---|---|
| 851,826 | 4/1907 | Morrow | 126/275 R |
| 2,928,386 | 3/1960 | Keyt et al. | 126/38 |
| 4,164,930 | 8/1979 | Johnston | 126/38 |
| 5,163,359 | 11/1992 | McLane, Sr. | 99/447 |
| 5,425,354 | 6/1995 | Park | 126/50 |
| 5,722,387 | 3/1998 | Chen | 126/45 |

*Primary Examiner*—Ira S. Lazarus
*Assistant Examiner*—David Lee
*Attorney, Agent, or Firm*—Erik M. Arnhem

[57] ABSTRACT

A portable gas-stove which includes a housing, a burner, a C-shaped tubular gas storage container a plurality of retaining hooks, an ignition means, and a top cover. The housing is provided with a plurality of air vents, base portion with a fixing slot for receiving the ignition means and a plurality of hook holders for holding the retaining hooks in place. The retaining hooks have arcuate hook portions for hooking and fixedly holding the gas storage container in the housing. The burner is centrally mounted in the housing and is provided at one side with a gas inlet. A gas connecting tube is connected between the gas inlet of the burner and a gas outlet on the gas storage container. The gas storage container can be refilled at any time by removably connecting a small gas cylinder to the container. This enables the gas-stove to be conveniently carried for use outdoors.

3 Claims, 3 Drawing Sheets

PORTABLE GAS-STOVE

BACKGROUND OF THE INVENTION

With the development of an industrial society, people are eager for various kinds of outdoor leisure activities for relaxation purposes. Picnic, fishing, barbecue, camping, and outdoor excursions are popular activities for such relaxation purposes. People will usually carry some food, water, and cooking equipment for use in such outdoor activities. A small gas stove is a convenient means for cooking outdoors. However, at least a gas cylinder or several small gas containers and a length of gas hose are needed along with the gas stove. It is not only inconvenient but also dangerous to carry a heavy and space-occupying gas-stove, gas cylinder, and gas hose for an outdoor activity. Also the connections between the gas cylinder, hose and gas-stove can sometimes.

It is therefore desirable to provide a portable gas-stove for convenient carrying and operation in outdoor activities to avoid the drawbacks existing in the conventional apparatus, ie. the gas-stove, heavy gas cylinder and connecting gas hose.

SUMMARY OF THE INVENTION

A primary object of the present invention is to provide a portable gas-stove which can be conveniently carried and refilled with gas for use outdoors at any time. To achieve the above and other objects of the present invention, there is provided a gas-stove assembled from a housing, a burner, a gas storage, a plurality of retaining hooks, an ignition means, and a top cover. The housing is provided at its side wall and base portions with a plurality of air vents, and at its base portion with a fixing slot for receiving the ignition means and a plurality of hook holders for holding the retaining hooks in place. The retaining hooks have front hook portions for hooking and fixedly holding the gas storage in the housing. The burner is fixedly mounted onto the base portion of the housing and is provided at one side with a gas inlet. A gas connecting tube is connected between the gas inlet of the burner and a gas outlet on the gas storage. The gas storage can be refilled at any time by removably connecting a small gas cylinder to the gas storage. This enables the gas-stove to be conveniently carried for use outdoors.

BRIEF DESCRIPTION OF THE INVENTION

DETAILED DESCRIPTION OF THE PREFERRED EMBODIMENT

Figure 1:
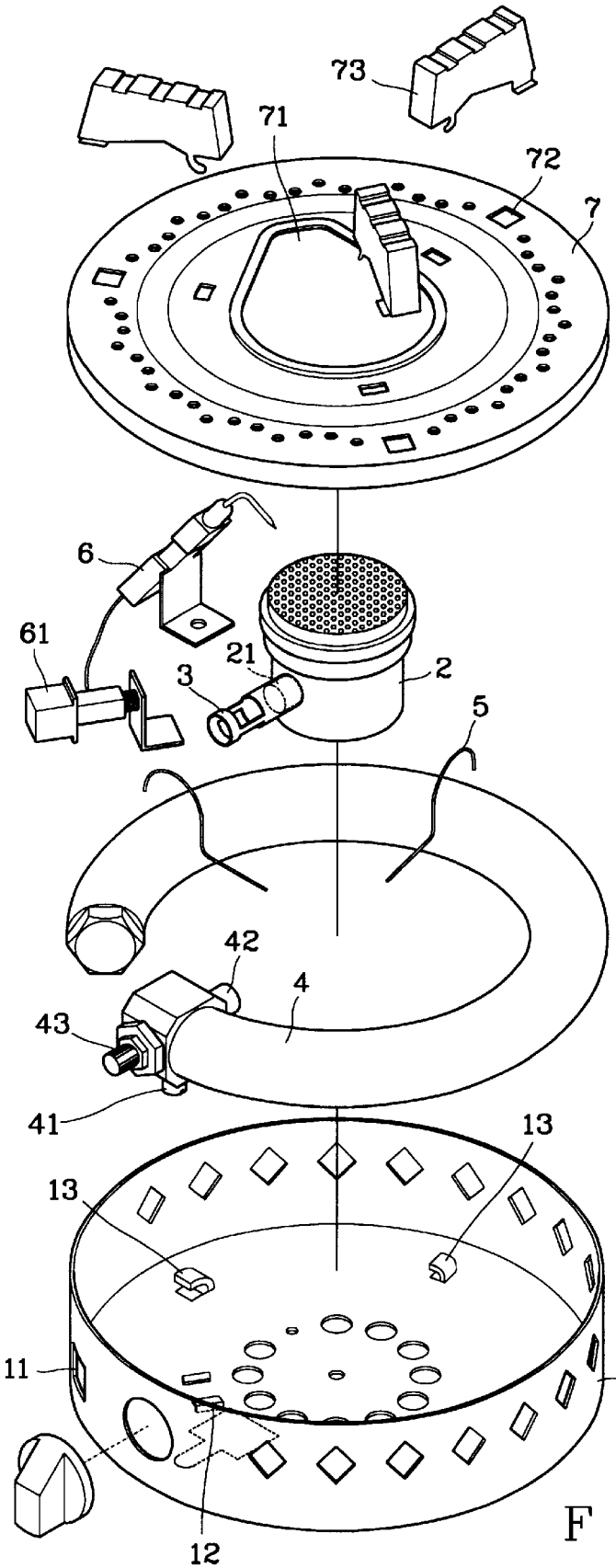
FIG. 1 is an exploded perspective of the present invention.
Figure 2:
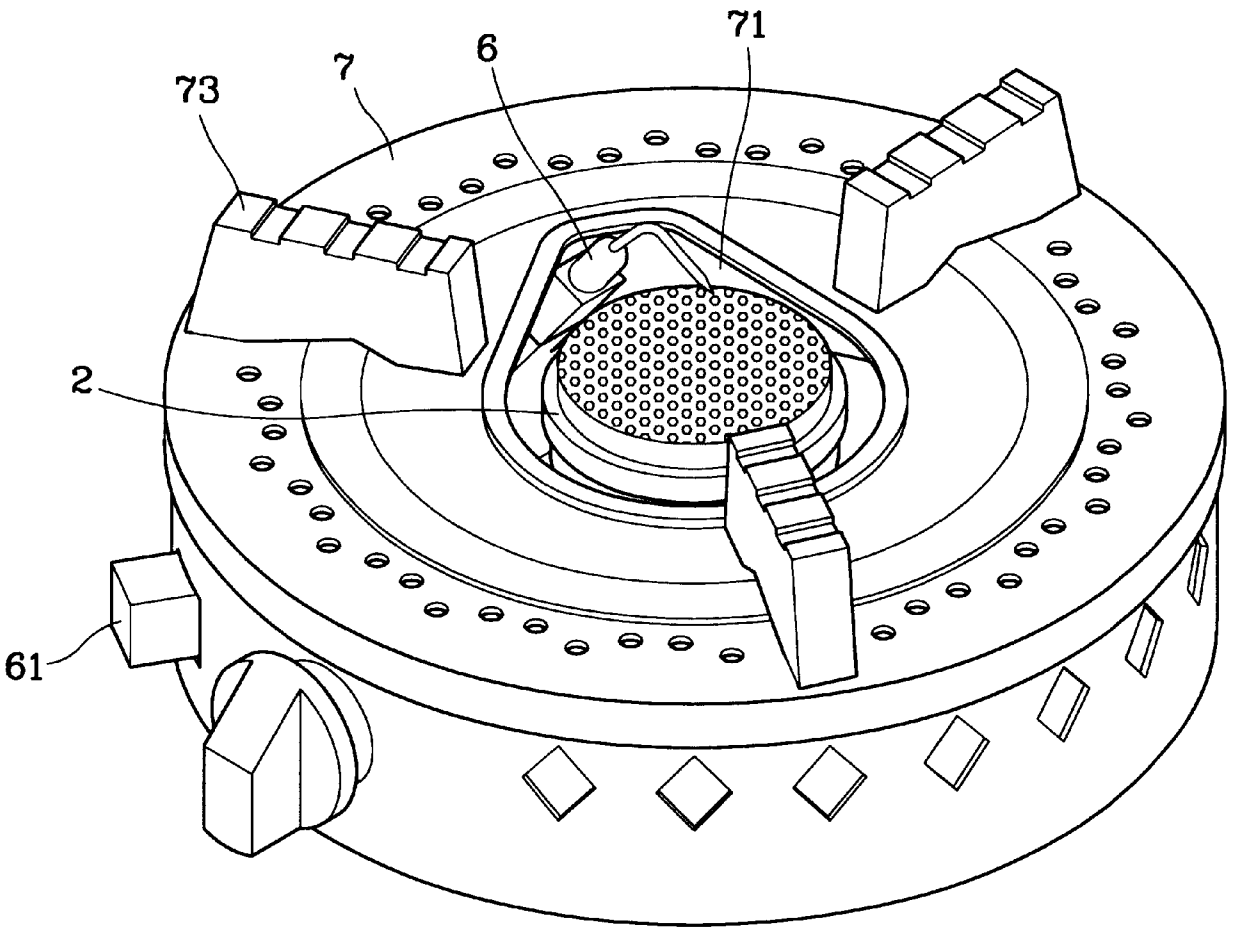
FIG. 2 is an assembled perspective of the present invention.

Please refer to FIGS. 1 and 2 which are exploded and assembled perspective views, respectively, of a portable gas-stove according to the present invention. As shown, the portable gas-stove includes a circular housing 1, a burner 2, a gas storage container 4, a plurality of retaining hooks 5, an ignition means 6, and a top cover 7.

The housing 1 is provided around cylindrical side its round wall portion and flat base portion with a plurality of air vents 11. A fixing slot 12 and a plurality of hook holders 13 are also provided on the base portion of the housing 1. The fixing slot 12 is used to receive the ignition means 6 therein. The hook holders 13 are used to clamp and locate the hooks 5 in place. A plurality of legs 14 are attached to a bottom surface of the base portion of the housing 1 (see FIG. 3) to support the whole gas-stove at a certain suitable height.

The burner 2 is positioned in the housing 1 and is fixedly connected to the base portion by means of screws. A gas inlet 21 is projected from one side of the burner 2. A gas connecting tube 3 is fitly connected at one end to the gas inlet 21.

The gas storage container 4 is positioned in the housing 1 and is an a C-shaped tubular member with two closed ends. One end of the gas storage container 4 is provided at a bottom side facing the base portion of the housing 1 with a gas refilling fitting 41 (see FIG. 3). Another end of the gas storage 4 is provided at an inner side facing the burner 2 with a gas outlet tube 42 which telescopes into the gas connecting tube 3. A manual valve 43 is provided on the gas storage container 4 in fluid flow connection with gas outlet 42 for controlling flow of gas passing through the gas outlet 42. As shown in FIG. 1, valve 42 is located in a closure cap for one end of tubular container 4. The gas refill fitting 41 (FIG. 3) is located on the closure cap for the other end of tubular member 4.

Each retaining hook 5 each has a front bent portion hooking the gas storage 4 and a rear straight portion being clamped by the hook holder 13, so that the gas storage 4 is fixedly located in the housing 1 by the retaining hooks 5.

The ignition means 6 is inserted into the fixing slot 12 formed on the base portion of the housing 1 and is locked thereto. A push-button actuator 61 projects from one side of the ignition means 6 through an opening in the housing 1 for a user to control the ignition of the gas-stove.

The top cover 7 is formed at central portion thereof with a burner opening 71. Three through holes 72 are formed on the top cover 7 around the burner opening 71 for three supporting blocks 73 to mount thereinto in the manner of press fit, so that the supporting blocks 73 are fixedly connected to the top cover 7.

To assemble the portable gas-stove of the present invention, first fixedly mount the burner 2 on the base portion of the housing 1 and put the gas storage container 4 around the burner 2. Separately extend the rear straight portions of the retaining hooks 5 through the hook holders 13 with the bent front portion of the retaining hooks 5 fitly hooking on the gas storage container 4.

Insert the ignition means 6 into the fixing slot 12 on the base portion of the housing 1 with the push-button switch 61 extending through the wall portion of the housing 1. Finally, close the top cover 7 over the housing 1 and press the supporting blocks 73 into the through holes 72 of the top cover 7. A portable gas-stove is now available for use.

Figure 3:
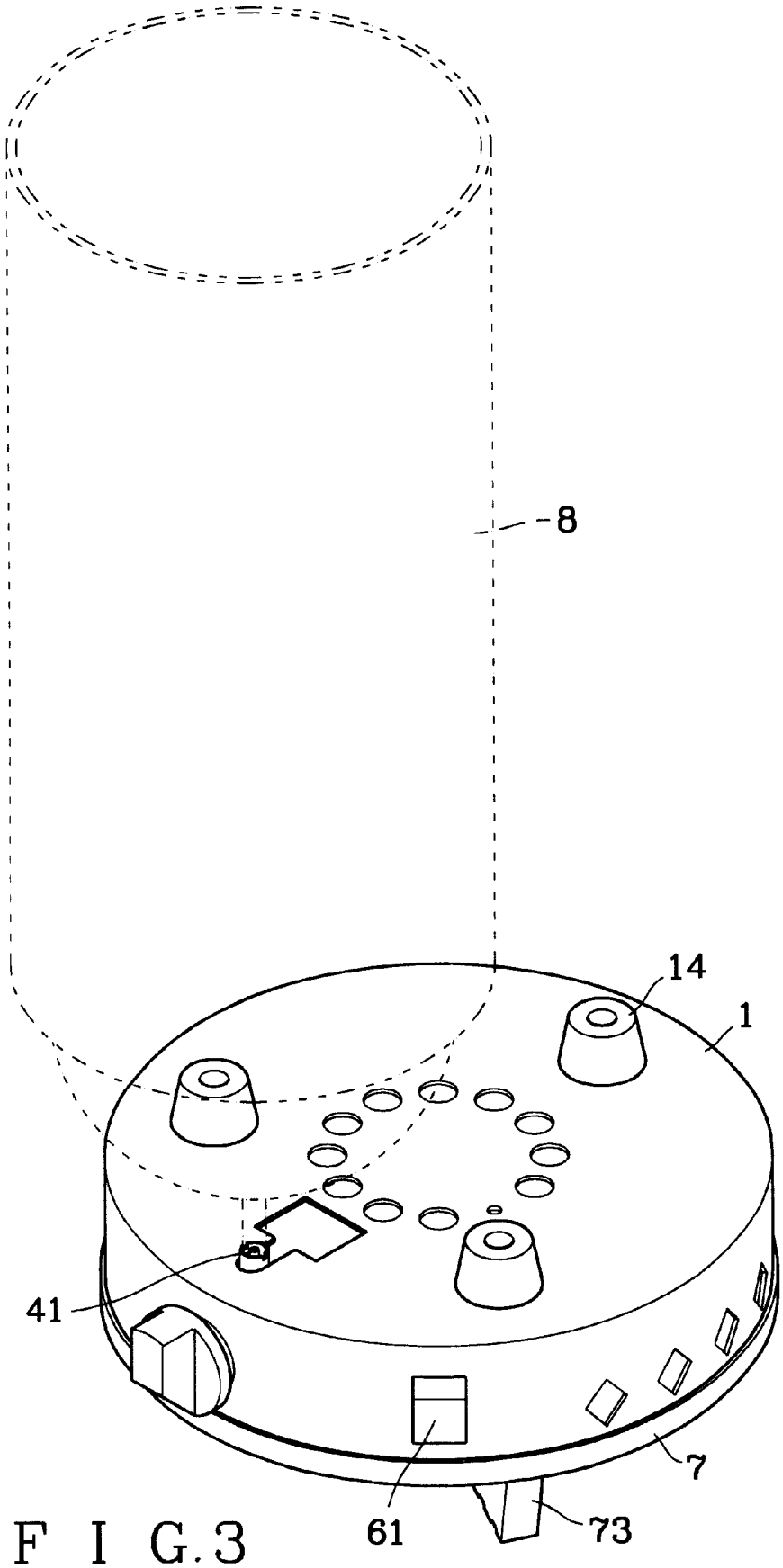
FIG. 3 illustrates the manner in which the portable gas-stove of the present invention is refilled with gas.

As shown in FIG. 3, when the gas in the gas storage 4 is low, the gas storage 4 can be very conveniently refilled by directly connecting a gas cylinder 8 to the gas refiller fitting 41 provided at the bottom side of one end of the gas storage 4. Thus, it is unnecessary to carry a conventional gas cylinder and gas hose along with the portable gas-stove of the present invention. A user may conveniently carry and use the gas-stove of the present invention outdoors at any time.

In brief, the portable gas-stove of the present invention is novel in design and practical for use.

What is claimed is:

1. A portable gas stove comprising:

a housing that includes a flat circular base and an upstanding cylindrical side wall extending from said base; plural air vents in said side wall;

a top cover for said housing spanning the space circumscribed by said cylindrical side wall; said cover having a centrally-located opening for a gas burner;

a gas burner positioned on said circular base so as to project upwardly through said burner opening;

a fuel gas storage container located within said housing in surrounding relation to said gas burner; said container comprising a C-shaped tubular member (4) having two closely-spaced ends; first and second caps closing the ends of said tubular member;

a manual control valve located on one of said caps for controlling flow of fuel gas out of said container; a gas refiller fitting on said other cap for adding fuel gas to the container; and an ignition means for said gas burner; said ignition means being located within said housing so as to project through the burner opening in the top cover; said ignition means having a manual actuator button extending through the housing side wall.

2. The portable gas stove of claim 1, wherein said burner has a fuel gas inlet tube (3) extending toward the manual control valve; said valve having a tubular gas outlet (42) telescoped into said inlet tube for supplying fuel gas to the burner.

3. The portable gas stove of claim 1, and further comprising means for detachably securing said tubular member (4) to the base of said housing; said securing means comprising plural hook holders (13) on said base, and a hook (5) secured to each holder; each said hook comprising a straight wire section positioned on the housing base and a curved wire section extending partially around the tubular member.

* * * * *